US007373942B1

(12) United States Patent
Yeager

(10) Patent No.: US 7,373,942 B1
(45) Date of Patent: May 20, 2008

(54) ADJUSTABLE WIDTH WALKER

(76) Inventor: Christine R. Yeager, 6003 Marsh Cir., Loveland, OH (US) 45140

( * ) Notice: Subject to any disclaimer, the term of this patent is extended or adjusted under 35 U.S.C. 154(b) by 0 days.

(21) Appl. No.: 11/650,612

(22) Filed: Jan. 8, 2007

(51) Int. Cl.
*A61H 3/04* (2006.01)

(52) U.S. Cl. ..... 135/67; 135/74; 135/75; 482/68

(58) Field of Classification Search ..... 135/65, 135/67, 74–75; 482/52, 66–68; 280/304.1, 280/647, 250.1, 87.021; D12/128–133
See application file for complete search history.

(56) References Cited

U.S. PATENT DOCUMENTS

| | | | | | |
|---|---|---|---|---|---|
| 3,688,789 | A * | 9/1972 | Bunch | 135/67 |
| 3,945,389 | A * | 3/1976 | Smith | 135/67 |
| 4,094,330 | A | 6/1978 | Jong | |
| 4,180,086 | A * | 12/1979 | Thomas | 135/67 |
| 4,298,016 | A * | 11/1981 | Garelick | 135/67 |
| 4,341,381 | A * | 7/1982 | Norberg | 482/67 |
| 4,411,283 | A * | 10/1983 | Lucarelli | 135/67 |
| 4,640,301 | A * | 2/1987 | Battiston et al. | 135/67 |
| 4,830,035 | A * | 5/1989 | Liu | 135/67 |
| 4,995,412 | A * | 2/1991 | Hirn et al. | 135/67 |
| 5,188,139 | A | 2/1993 | Garelick | |
| 5,201,333 | A * | 4/1993 | Shalmon et al. | 135/67 |
| 5,255,696 | A * | 10/1993 | Leonard | 135/67 |
| 5,275,187 | A * | 1/1994 | Davis | 135/67 |
| 5,433,235 | A * | 7/1995 | Miric et al. | 135/67 |
| 5,499,645 | A * | 3/1996 | Baliga | 135/67 |
| 5,529,425 | A * | 6/1996 | Spies et al. | 403/322.4 |
| 6,729,342 | B2 * | 5/2004 | Serhan | 135/67 |
| 6,886,575 | B2 * | 5/2005 | Diamond | 135/74 |

* cited by examiner

*Primary Examiner*—Winnie Yip
(74) *Attorney, Agent, or Firm*—Charles R. Wilson

(57) ABSTRACT

A walker is made adjustable for various sizes of persons, including grossly obese persons. The walker includes two side support members, each of which has a front leg, a back leg, and a cross leg connecting the two legs. A braced sleeve assembly is positioned on the front leg of each side support member. The braced sleeve assembly has an elongated first sleeve dimensioned to slide over the front leg, an elongated second sleeve extending horizontally and inwardly from the elongated first sleeve, and a support brace extending at an angle from one sleeve to the other sleeve. The second sleeve has a set of spaced positioning holes. A releasable latch is mounted to the elongated first sleeve. The walker further includes a cross bar dimensioned to slide inside the second sleeves of the braced sleeve assemblies. Spring buttons on each end of the cross bar is mated with one of the spaced positioning holes of each braced sleeve assembly thereby allowing the distance between the side support members to be adjusted depending on which of the spaced positioning holes is selected. The walker's width is adjustable according to need. Further, the walker is capable of being folded to a compact state by releasing the latches to allow the side support members to revolve inwardly.

20 Claims, 5 Drawing Sheets

ADJUSTABLE WIDTH WALKER

FIELD OF THE INVENTION

This invention relates to a walker. More particularly, the invention relates to an adjustable width walker capable of folding to a compact state for storage purposes.

BACKGROUND OF THE INVENTION

Walkers for assisting individuals who are crippled, disabled or otherwise weakened have been used for many years. The walkers serve primarily as an aid by which the individual can use the arms to take some strain off the legs. They also provide a stabilizing 10 means to those individuals who have an impaired sense of equilibrium.

Those walkers which have become most popular tend to have an open frame structure with two inverted U-shaped side members and a cross bar permanently connecting the side members together. In effect, the walkers have four legs which make the walkers very stable. The cross bar normally is itself very sturdy, sufficient to withstand the full weight of the average person. It is the framed nature of the walker which makes it stable in use. More recently, walkers have been made with latch mechanisms which allow 20 the walkers to collapse upon themselves to create a more compact structure for ease of storage and transport.

Health care institutions such as hospitals and physical therapy facilities need to have on hand several walkers to serve their patients. Those patients can range in height from short to tall 25 and in weight from slim to heavy. There are a significant number of overweight patients who can be considered grossly obese. Walkers currently commercially available all have height adjusting legs to accommodate different heights of patients. The same walkers typically come in three standard widths to accommodate three broadly classified weight groups of persons. The institutions must have a sufficient number of each of those walkers available on a daily basis to meet an unpredictable need. Past usage dictates to a certain extent the number of each of the three width category walkers which are needed. To ensure a walker need can be instantly met, the institution must have an oversupply of each of all three width categories of walkers. This creates a cost problem. It also creates a storage problem in that the walkers typically are used during daytime hours, but must be stored during the nighttime. The folding feature found on many walker models alleviates somewhat the storage problem. However, the cost problems associated with an excess in each of the width categories of walkers remains as does the consequent storage problem.

U.S. Pat. No. 4,094,330 discloses a walker which recognizes the need for a walker to have a width adjusting feature. The disclosed walker is useful to a limited extent. The patented walker can only handle medium weight persons because of the nature of its structure. It also is cumbersome to use and cannot be folded. It simply does not fully solve the aforementioned cost and storage problems.

In accord with a need experienced by many health care institutions for many years, there has now been developed a unique walker. The walker accommodates many sizes of persons. It most importantly can support the weight of persons who are obese. It can as well be stored or transported with ease due to a folding feature.

SUMMARY OF THE INVENTION

A walker is designed to accommodate several different sized persons. It is capable of supporting obese persons in need of a walker and is capable of being folded to a compact state for ease of storage or travel. The walker includes spaced apart side support members connected together by a cross bar. The cross bar is held in an adjustable width position by braced sleeve assemblies which are positioned on the side support members. The walker's width is readily adjusted according to the size of the person using it. A latch is operably associated with each braced sleeve assembly to allow the side support members to individually revolve from a latched in-use position to an unlatched fold position.

DETAILED DESCRIPTION OF THE INVENTION

The walker of the invention is described in the following paragraphs with reference to the drawings. It is intended primarily for use by health care institutions which have a daily need for different sized walkers to accommodate the many sizes of its patients. The walker can as well be used in homes where a person one time selects the desired walker width according to need and likely never again needs to make width adjustments.

Figure 1:
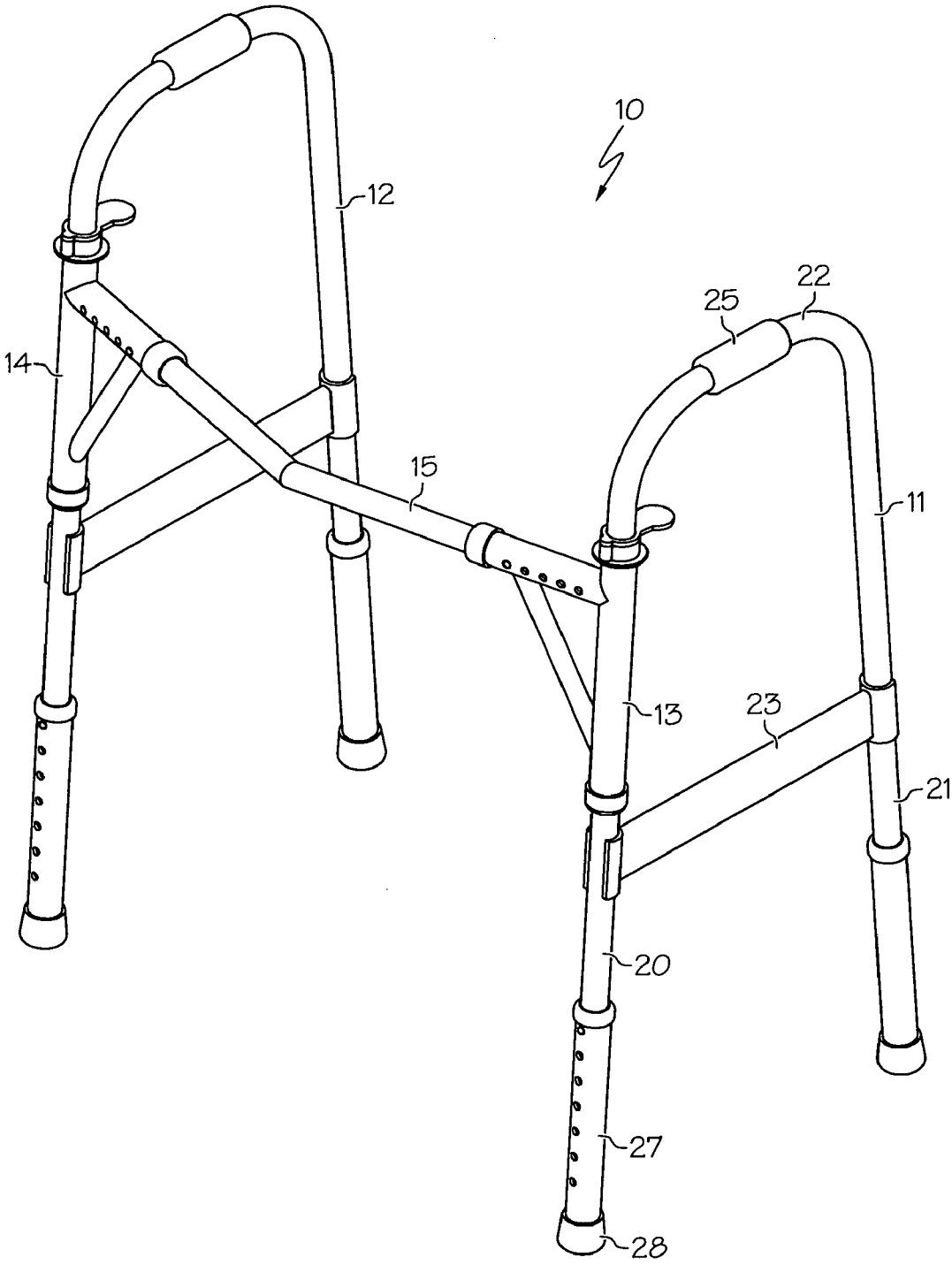
FIG. 1 is a view in perspective of the walker of the invention.

With reference to FIG. 1, there is shown the walker 10 of the invention. The walker 10 comprises a first side support member 11 and an opposed second side support member 12. Braced sleeve assemblies 13 and 14 are positioned on the first side support member 11 and on the second side support member 12, respectively. A cross bar 15 connects the two side support members together in an adjustable width manner.

The side support members 11 and 12 are identical in their structure. Each has a generally vertical front leg 20, a generally vertical back leg 21, an upper substantially horizontal cross leg 22 connecting the generally vertical legs and a mid-level cross brace 23 extending from the generally vertical front leg to the generally vertical back leg. As shown, the generally vertical legs and substantially horizontal cross leg are formed from tubing which has been bent to give an inverted U-shaped structure. The vertical legs are flared apart at the bottom for maximum walker stability. The side support member can as well be formed from three legs permanently connected together or two inverted J-shaped legs permanently connected together.

The legs of the side support members are formed from a light-weight material to facilitate a sliding or a lifting of the walker. Aluminum, stainless steel and plastic are preferred materials. Hollow tubes of the above materials with a diameter selected according to the weight that must be supported are ideal.

An optional handle grip 25 is provided on the horizontal cross leg 22 for ease of gripping by the patient during use. The mid-level cross brace 23 is highly preferred for stability purposes in holding together the vertical legs of the side support member during use.

Another highly preferred feature found on each side support member 11 and 12 is a set of adjustable leg extensions 27. The leg extensions are mounted on all the vertical legs at their lower extremities. They are currently found on most commercially available walkers. They are tubular sleeves with a set of holes extending along their lengths. While not apparent in the drawings, the vertical legs all have a spring button mounted therein to protrude through one of the holes in an associated leg extension. As should be apparent, the leg extensions are used to increase the length of each of the side support vertical legs according to the height of the patient. Ideally, the patient can comfortably grasp the grip handles on the side support members when his or her arms are held at the side. This adjustment is accomplished in a routine manner with the leg extensions. Foot pads 28 are mounted on the terminus of the leg extensions as an anti-slide feature. Casters or wheels could as well be used.

Still with reference to FIG. 1, the first braced sleeve assembly 13 is mounted on the front leg of the first side support member 11 and the second braced sleeve assembly 14 is mounted on the front leg of the second side support member 12. The two braced sleeve assemblies are identical in structure and function. Each is to provide a means of adjusting the distance between the two side support members and to allow an associated side support member to revolve inwardly to a folded state.

Figure 2:
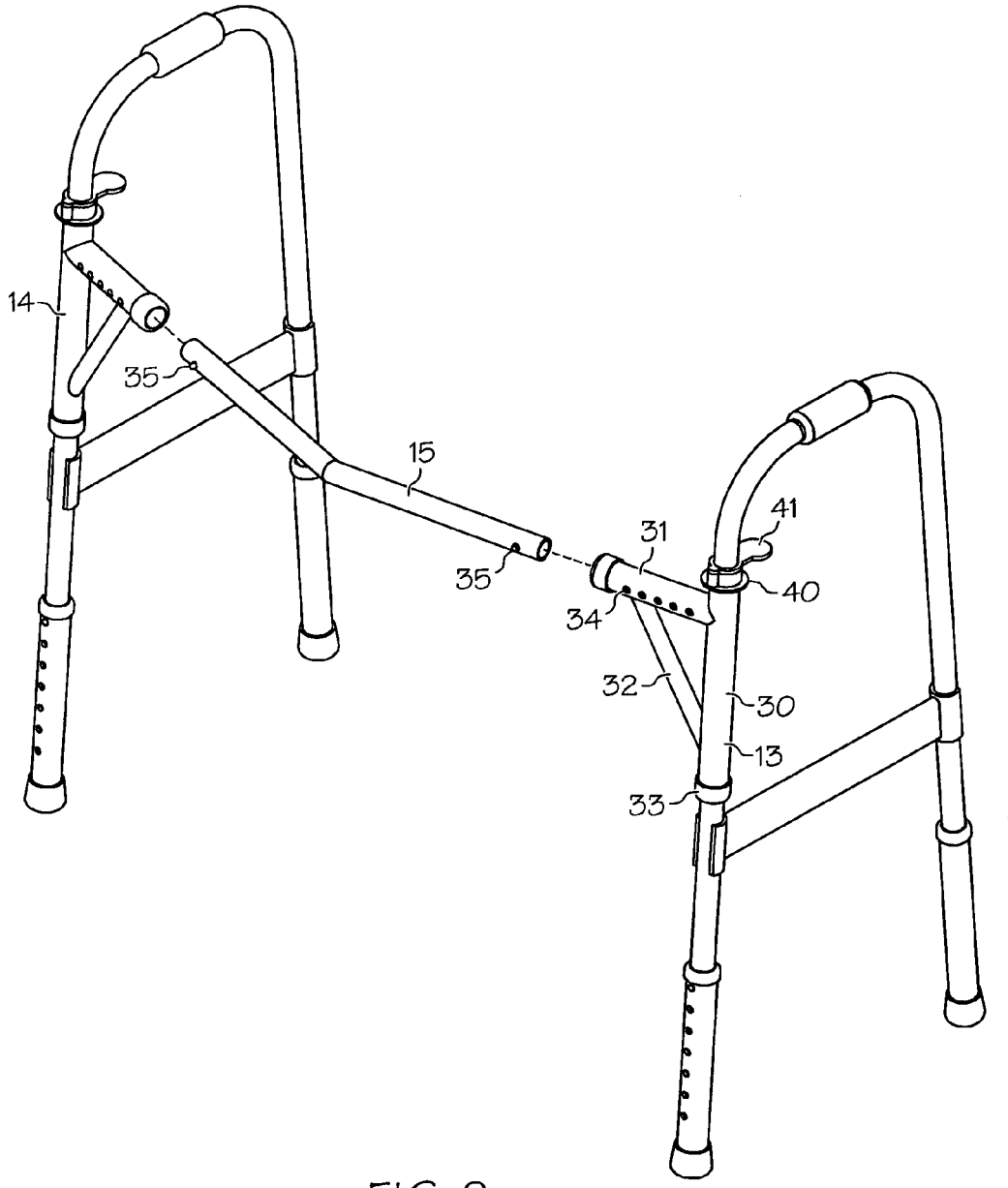
FIG. 2 is an exploded view of the walker of FIG. 1.

Now with reference to FIG. 2, the braced sleeve assembly 13 has an elongated first sleeve 30, an elongated second sleeve 31 and a support brace 32 extending from the elongated first sleeve to the elongated second sleeve. The two elongated sleeves are permanently attached at about right angles to one another with the second sleeve extending substantially horizontally from near the upper terminus of the elongated first sleeve. The elongated first sleeve is dimensioned to slide over the front leg of the side support member while the second sleeve is dimensioned to receive the cross bar 15. The support brace 32 extends at an angle from the lower part of the elongated first sleeve 30 to the elongated second sleeve 31. Preferably, a stop 33 is positioned on the front leg of the side support member to hold the braced sleeve assembly at the proper height.

The support brace 32 of each braced sleeve assembly is required to give the walker the strength needed to support an obese person. The added strength is needed since it is common for users of walkers to lean on the walker's cross bar for rest or otherwise. The support brace 32 is permanently attached to near a lower terminus of the brace assembly's elongated first sleeve 30 and extends at an angle to near a free terminus of the brace assembly's elongated second sleeve 31 where it is permanently attached. The brace is attached to the elongated second sleeve at an angle of from about thirty degrees to about sixty degrees for optimum weight bearing purposes. The brace on each braced sleeve assembly together with the enhanced strength provided by the cross bar 15 extending into the elongated second sleeve of each braced sleeve assembly as described below gives the adjustable width walker of the invention its needed strength for the forces it may encounter.

Still with reference to FIG. 2, the elongated second sleeve 31 has a set of at least two equi-spaced positioning holes 34 extending along its length. Five holes are shown, though a greater number or a lesser number of holes can be used depending on the number of widths desired for the walker. The distal hole, that hole being the hole farthest from the side frame member, is located at least about one inch from the elongated second sleeve's free terminus. Preferably, from three to six holes are spaced along the second sleeve at about one inch spacings with the distal hole located from about two inches to about three inches from its free terminus. The walker with the preferred braced sleeve assemblies collectively would then have from six to twelve different width settings. The overall width of this preferred walker ranges from about fifteen inches to about thirty inches.

Figure 5:
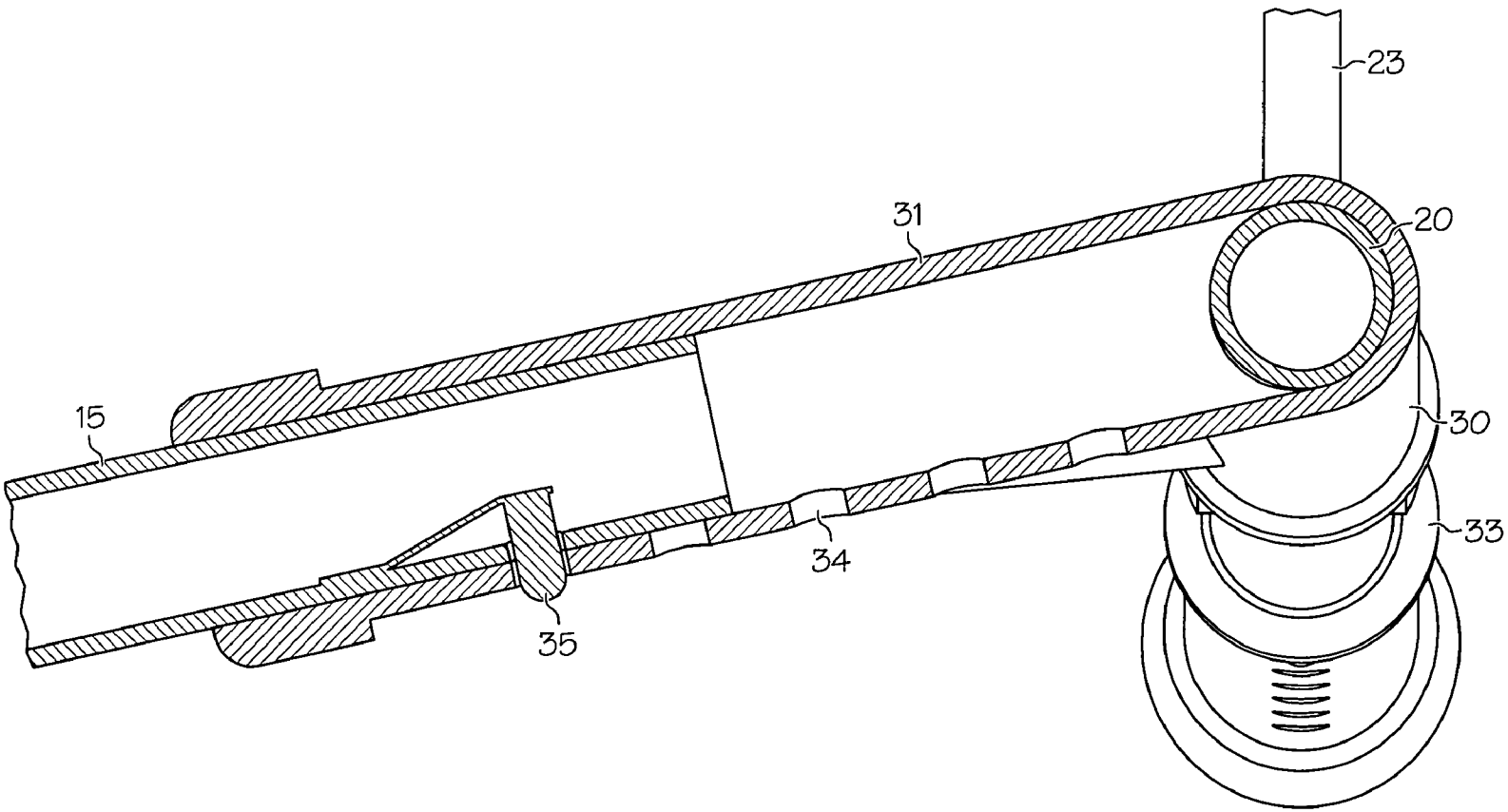
FIG. 5 is a top view in section of the braced sleeve assembly found on the walker of FIG. 3 taken along line 5-5 thereof.

The cross bar 15 which extends from the first braced sleeve assembly 13 mounted on the first side support member 11 to the second braced sleeve assembly 14 mounted on the second side support member 12 is a hollow tube. It can be a straight tube, but preferably as shown is bent slightly outwardly at its center to better receive the person using the walker and to allow the walker to fold to a more flat state. Now with reference to FIG. 5, the cross bar has a spring button 35 mounted near each end. Each spring button has a diameter slightly less than that of the spaced positioning holes in the second sleeve of the braced sleeve assemblies. The spring buttons 35 on the cross bar 15 are located at least about one inch from each terminus of the cross bar. Preferably, each spring button 35 is located about one inch to about three inches from a terminus of the cross bar. The locations of the positioning holes in the second sleeve assemblies and the location of the spring buttons in the cross bar ensure that there is at least about two inches, preferably at least about three inches, of cross bar/sleeve overlap for enhanced strength.

The spring button of the type shown is depressed inwardly while the cross bar is slid within the elongated second sleeve of the braced sleeve assembly until a selected hole is reached, at which time the spring button pops outwardly to protrude through the hole. Spring buttons of the type depicted are commercially available and conventionally used on equipment of this nature. For these reasons, they are highly preferred, though, equivalent attachment mechanisms can be used. For example, the positioning holes 34 in the second sleeve can extend fully through the sleeve and a set of aligned holes spaced along the cross bar 15. Thumb screws or the like inserted through the aligned holes securely holds the cross bar and braced assemblies in a selected width.

Again with reference to FIG. 2, the braced sleeve assembly 13 has a latch 40 operably associated with it to latch the braced sleeve assembly in the open position during use and in the closed 25 position during a folded or non-use position. A thumb pad release 41 is easily reached. Latches for this purpose are commercially available.

In operation, the patient or care giver determines the approximate width of the walker needed. The spring buttons on the cross bar are depressed, one at a time, and the cross bar slid into the elongated second sleeves of the braced sleeve assemblies until the preselected holes for the desired width are reached. The spring buttons are released and the walker matched to the patient. A second adjustment is made if needed. When the walker is no longer needed, the latch mechanisms on the walker are released to allow both side support members to revolve inwardly until they are substantially parallel to the cross bar. This flattened state allows a more convenient way to transport or store the walker.

Figure 3:
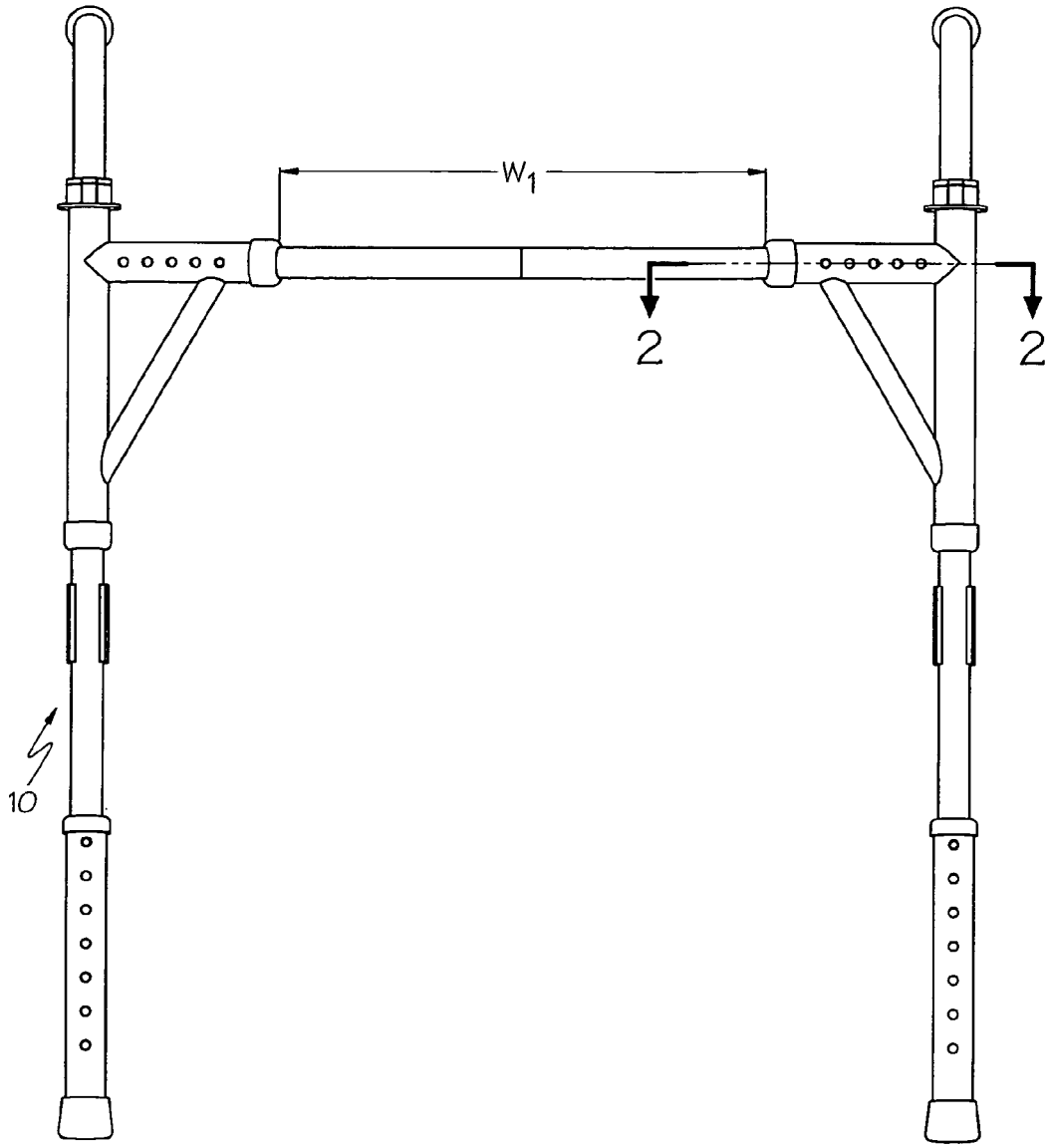
FIG. 3 is a front elevation view of the walker of FIG. 1 showing the walker's width adjusted to an expanded state to accommodate an obese person.
Figure 4:
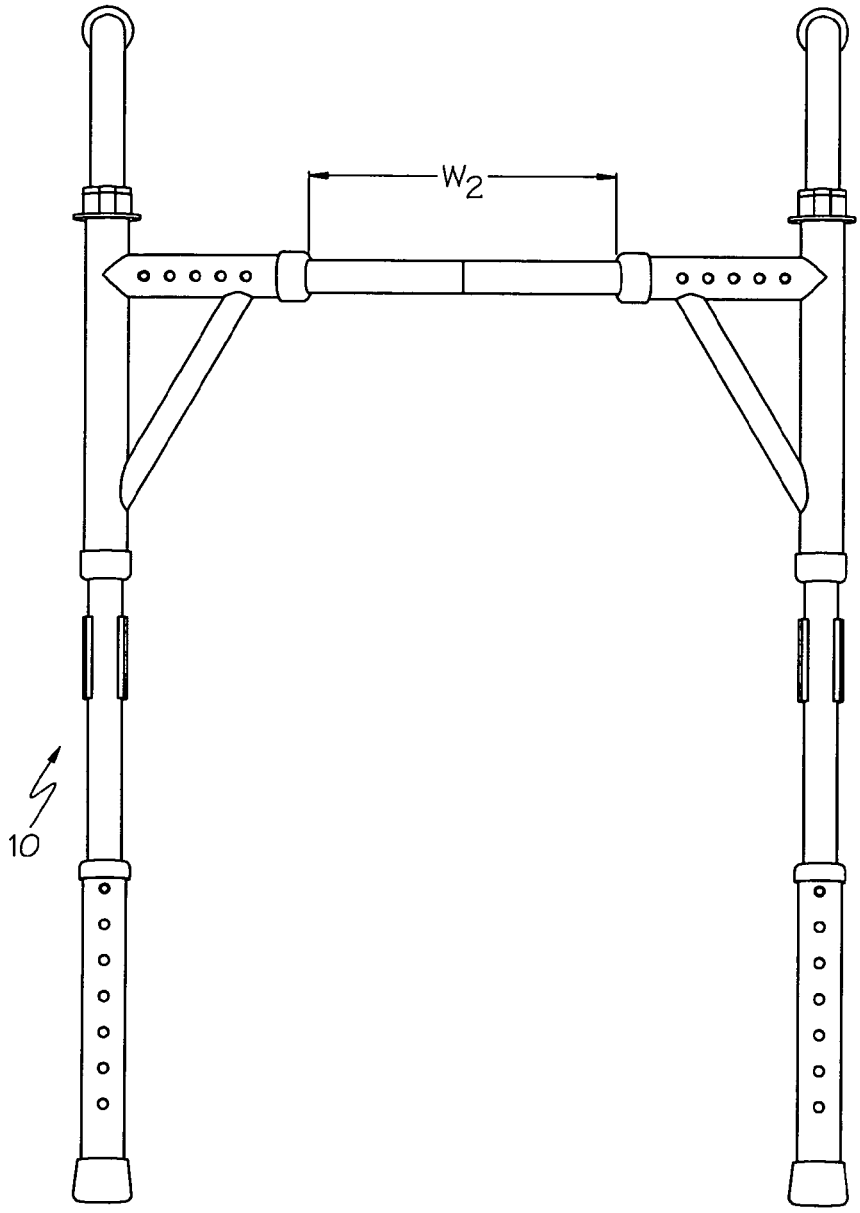
FIG. 4 is a front elevation view of the walker of FIG. 1 showing the walker's width adjusted to a narrowed state to accommodate a slim person.

Advantages of the walker of the invention are readily appreciated by the institution which uses them as well as the patient. A single walker can be stocked to meet the demands of the many sized persons. The height and, most importantly, the width of the walker is quickly changed according to need. As seen in FIG. 3, the walker 10 with its cross bar fully extended to a width W1 accommodates what is considered a grossly obese patient. The same walker 10, as seen in FIG. 4, with its cross bar fully slid into the elongated second sleeves to create a width W2, accommodates the slender patient. The patient in each case can comfortably hold his or her arms in a natural position and grasp the grips on the side support members. The patient's full weight can be made to bear on the walker without a fear of collapsing.

Optional features can be added to the walkers of the invention. For example, shaped arm rests can be mounted on the horizontal cross leg of the walker's side support members for comfort of the patient when a standing rest is needed. Anti-slip tips can be attached to the bottom of the leg extensions. Wheels or coasters can be installed on the front and/or back leg extensions to aid in its mobility. Still other features are added as desired.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A walker for accommodating persons of widely varying weights and having ease of storage capability, comprising:

(a) a pair of spaced apart side support members, each said side support member having a generally vertical front leg, a generally vertical back leg, and an upper substantially horizontal cross leg extending from and connecting the generally vertical legs;

(b) a pair of braced sleeve assemblies, each braced sleeve assembly positioned on the front leg of one of the side support members and having (1) an elongated first sleeve dimensioned to slide onto the front leg, (2) an elongated second sleeve secured at one end to and extending inwardly from the elongated first sleeve at an about right angle wherein the elongated second sleeve has a set of spaced positioning holes extending lengthwise therealong, (3) a support brace attached to a lower part of the elongated first sleeve and attached to the elongated second sleeve, and (4) a releasable latch mounted to the elongated first sleeve and operably associated with the front vertical leg of the side support member to allow the side support member to revolve inwardly towards the elongated second sleeve; and (c) a cross bar extending from the braced sleeve assembly positioned on one side support frame to the braced sleeve assembly positioned on the other side support frame, wherein the cross bar has an attachment mechanism near each end to adjustably engage a selected positioning hole in its associated braced sleeve assembly, whereby the distance between the side support members is adjusted depending on the size of the person using the walker by moving the cross bar inwardly or outwardly through the elongated first sleeve of at least one brace assembly until its attachment mechanism engages a positioning hole to semi-permanently secure its position and whereby the walker is folded inwardly by releasing each latch to allow the side support members to revolve inwardly to form a compact structure for ease of storage.

2. The walker of claim 1 wherein a distal positioning hole on the elongated second sleeve of each braced sleeve assembly is at least about one inch from its terminus.

3. The walker of claim 2 wherein the elongated second sleeve of each braced sleeve assembly has at least two spaced positioning holes.

4. The walker of claim 3 wherein the elongated second sleeve of the braced sleeved assembly has from three spaced positioning holes to six spaced positioning holes.

5. The walker of claim 4 wherein the cross bar is slidably mounted in the elongated second sleeves of the braced sleeve assemblies.

6. The walker of claim 1 further wherein the generally vertical front and back legs each has an adjustable length leg section mounted to a lower terminus of said generally vertical front and back legs.

7. The walker of claim 6 wherein the attachment mechanism of the cross bar is a spring button located at least about one inch from each terminus.

8. The walker of claim 6 wherein the generally vertical front and back legs and the cross leg of each side support member is a continuous length tube configured to an arch-shape.

9. The walker of claim 1 wherein the each side support member revolves inwardly about 90 degrees from a fully open position for use to a closed position for storage.

10. The walker of claim 1 wherein the latch on each braced sleeve assembly has a thumb pad release.

11. A walker for accommodating persons of widely varying weights and having ease of storage capability, comprising:

(a) a first side support member and a second side support member, each said side support member having a generally vertical front leg, a generally vertical back leg, an upper substantially horizontal cross leg extending from and connecting the generally vertical legs, and a mid-level cross brace extending from the generally vertical front leg to the generally vertical back leg;

(b) a first braced sleeve assembly positioned on the front leg of the first side support member and a second braced sleeve assembly positioned on the front leg of the second side support member, each said braced sleeve member having (1) an elongated first sleeve dimensioned to slide onto the front leg, (2) an elongated second sleeve secured at one end to and extending inwardly from the elongated first sleeve at an about right angle wherein the elongated second sleeve has at least two spaced positioning holes extending lengthwise therealong with a distal hole located at least about one inch from its free terminus, (3) a support brace attached to a lower part of the elongated first sleeve and attached to the elongated second sleeve near a free end thereof, and (4) a releasable latch mounted to the elongated first sleeve and operably associated with the front vertical leg of the side support member to allow the side support member to revolve inwardly towards the elongated second sleeve; and (c) an elongated cross bar having a first end and a second end, said elongated cross bar positioned in the elongated second sleeve of the first braced sleeve assembly positioned on the first side support frame and the second braced sleeve assembly positioned on the second side support frame, wherein the cross bar has a spring button located at least about one inch from its first end and a spring button located at least about one inch from its second end to adjustably engage a selected positioning hole in the elongated second sleeves of the braced sleeve assemblies, whereby the distance between the side support members is adjusted depending on the size of the person using the walker by moving the cross bar inwardly or outwardly through the elongated first sleeve of at least one brace assembly until its spring button extends through a positioning hole to semi-permanently secure its position and whereby the walker is folded inwardly by releasing each latch to allow the side support members to revolve inwardly to form a compact structure for ease of storage.

12. The walker of claim 11 wherein its width ranges from about fifteen inches to about thirty inches.

13. The walker of claim 11 wherein the elongated second sleeve of each braced sleeved assembly has from three spaced positioning holes to six spaced positioning holes with a distal hole located from about two inches to about three inches from a free terminus.

14. The walker of claim 11 further wherein the generally vertical legs of the first and second side support members each has an adjustable length leg section mounted to a lower terminus of said generally vertical front and back legs.

15. The walker of claim 14 wherein each of the adjustable length leg sections has a foot pad at a terminus.

16. The walker of claim 14 wherein the generally vertical front and back legs and the cross leg of each side support member is a continuous length tube configured to an arch-shape.

17. The walker of claim 11 wherein the each side support member revolves inwardly about 90 degrees from a fully open position for use to a closed position for storage.

18. The walker of claim 11 wherein the latch on each braced sleeve assembly has a thumb pad release.

19. An adjustable width walker having ease of storage capability, comprising:

(a) a first side support member and a second side support member, each said side support member having a generally vertical front leg, a generally vertical back leg, an upper substantially horizontal cross leg extending from and connecting the generally vertical legs, and a mid-level cross brace extending from the generally vertical front leg to the generally vertical back leg;

(b) a first braced sleeve assembly positioned on the front leg of the first side support member and a second braced sleeve assembly positioned on the front leg of the second side support member, each said braced sleeve member having (1) an elongated first sleeve dimensioned to slide onto the front leg, (2) an elongated second sleeve secured at one end to and extending inwardly from the elongated first sleeve at an about right angle wherein the elongated second sleeve has from three spaced positioning holes to six spaced positioning holes extending lengthwise therealong, (3) an angled support brace attached to a lower part of the elongated first sleeve and attached to the elongated second sleeve, and (4) a releasable latch mounted to the elongated first sleeve and operably associated with the front vertical leg of the side support member to allow the side support member to revolve inwardly towards the elongated second sleeve; and (c) an elongated cross bar having a first end and a second end, said elongated cross bar slidably positioned within the elongated second sleeve of (1) the first braced sleeve assembly positioned on the first side support frame, and (2) the second braced sleeve assembly positioned on the second side support frame, wherein the cross bar has a spring button near its first end and near its second end to adjustably engage a selected positioning hole in the elongated second sleeves of the braced sleeve assemblies, whereby the distance between the side support members is adjusted depending on the size of the person using the walker by moving the cross bar inwardly or outwardly through the elongated first sleeve of each brace assembly until its spring button near each end of the cross bar extends through a positioning hole to semi-permanently secure its position and whereby the walker is folded inwardly by releasing each latch to allow the side support members to revolve inwardly to form a compact structure for ease of storage.

20. The walker of claim 19 wherein a distal hole on each elongated second sleeve of the braced sleeve assemblies is located from about two inches to about three inches from the second sleeve's free terminus and the spring buttons on the cross bar are located from about one inch to about three inches from each terminus so that at least about three inches of cross bar/second sleeve overlap is created for enhanced strength.

* * * * *